United States Patent [19]

Bullock

[11] Patent Number: 4,537,138

[45] Date of Patent: Aug. 27, 1985

[54] RADIAL TRUCKS

[75] Inventor: Robert L. Bullock, Lombard, Ill.

[73] Assignee: Standard Car Truck Company, Park Ridge, Ill.

[21] Appl. No.: 510,764

[22] Filed: Jul. 5, 1983

[51] Int. Cl.[3] ..... B61F 3/08; B61F 5/38; B61F 5/00

[52] U.S. Cl. ..... 105/168; 105/167; 105/165

[58] Field of Search ..... 105/165–169, 105/224.1, 218 R, 157 R

[56] References Cited

U.S. PATENT DOCUMENTS 4,373,446 2/1983 Cope ..... 105/224.1

4,455,946 6/1984 List ..... 105/224.1

*Primary Examiner*—Randolph A. Reese

*Assistant Examiner*—Dennis C. Rodgers

*Attorney, Agent, or Firm*—Kinzer, Plyer, Dorn & McEachran

[57] ABSTRACT

A railroad truck includes a pair of side frames with wheeled axles mounted there between. A roller bearing adaptor is mounted upon a roller bearing at each end of each axle with the side frames being mounted upon a shear pad mounted on the roller bearing adaptors. There is a subframe for interconnecting the wheeled axles by connecting opposite corner adaptors and there is a rigid connection between each adaptor and the subframe. Each rigid connection includes an adaptor portion and a subframe portion, with said portions being relatively vertically disposed. There are vertical fastening means connecting said vertically disposed adaptor and subframe portions. The vertically disposed portions have cooperating means thereon which substantially eliminate horizontal shear forces upon the fastening means.

3 Claims, 6 Drawing Figures

RADIAL TRUCKS

SUMMARY OF THE INVENTION

The present invention relates to railroad trucks and in particular to improvements in radial self-steering trucks.

A primary purpose of the invention is a radial self-steering railroad truck providing for an improved connection between the roller bearing adaptors and the subframe connecting opposite corners of the truck axles.

Another purpose is a railroad truck of the type described which improved connection between the subframe and the roller bearing adaptor is rigid and which substantially eliminates horizontal shear loads on the fastening means thereof.

Another purpose is a rigid connection for a railroad truck connecting a subframe and a roller bearing adaptor which connection essentially eliminates horizontal shear forces on the fastening means.

Another purpose is to essentially eliminate fluctuating loads in the fastening means due to dynamic horizontal forces of the subframe, thus preventing fatigue failure of the fastening means.

Another purpose is a connection for a railroad truck subframe and roller bearing adaptor which is rigid and can be quickly and easily assembled and disassembled with tools normally found at a railroad repair in place (RIP) track.

Other purposes will appear in the ensuing specification, claims and drawings.

BRIEF DESCRIPTION OF THE DRAWINGS

The invention is illustrated diagrammatically in the following drawings wherein.

DESCRIPTION OF THE PREFERRED EMBODIMENT

Figure 1:
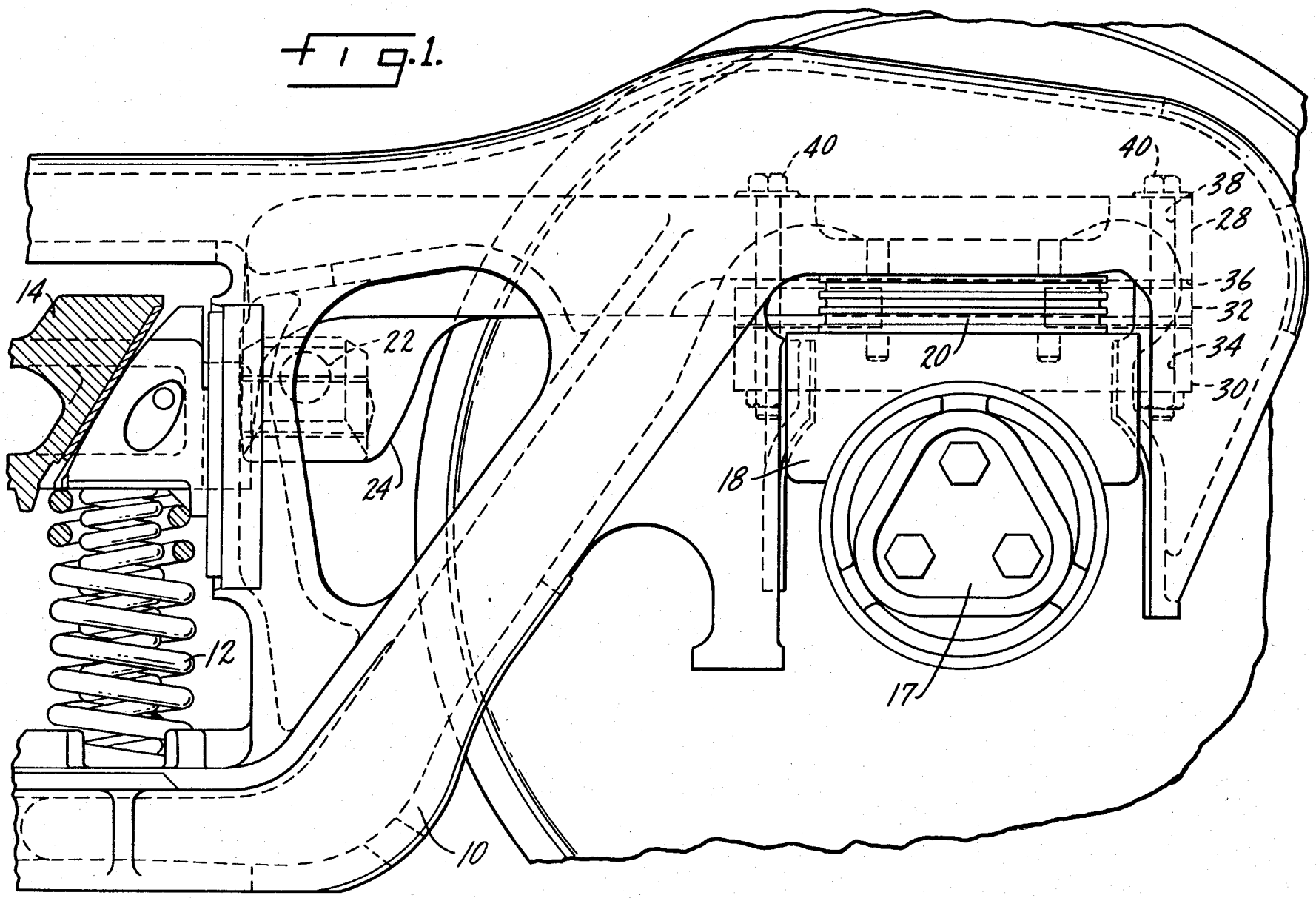
FIG. 1 is a partial side view with portions in section of a railroad truck.
Figure 2:
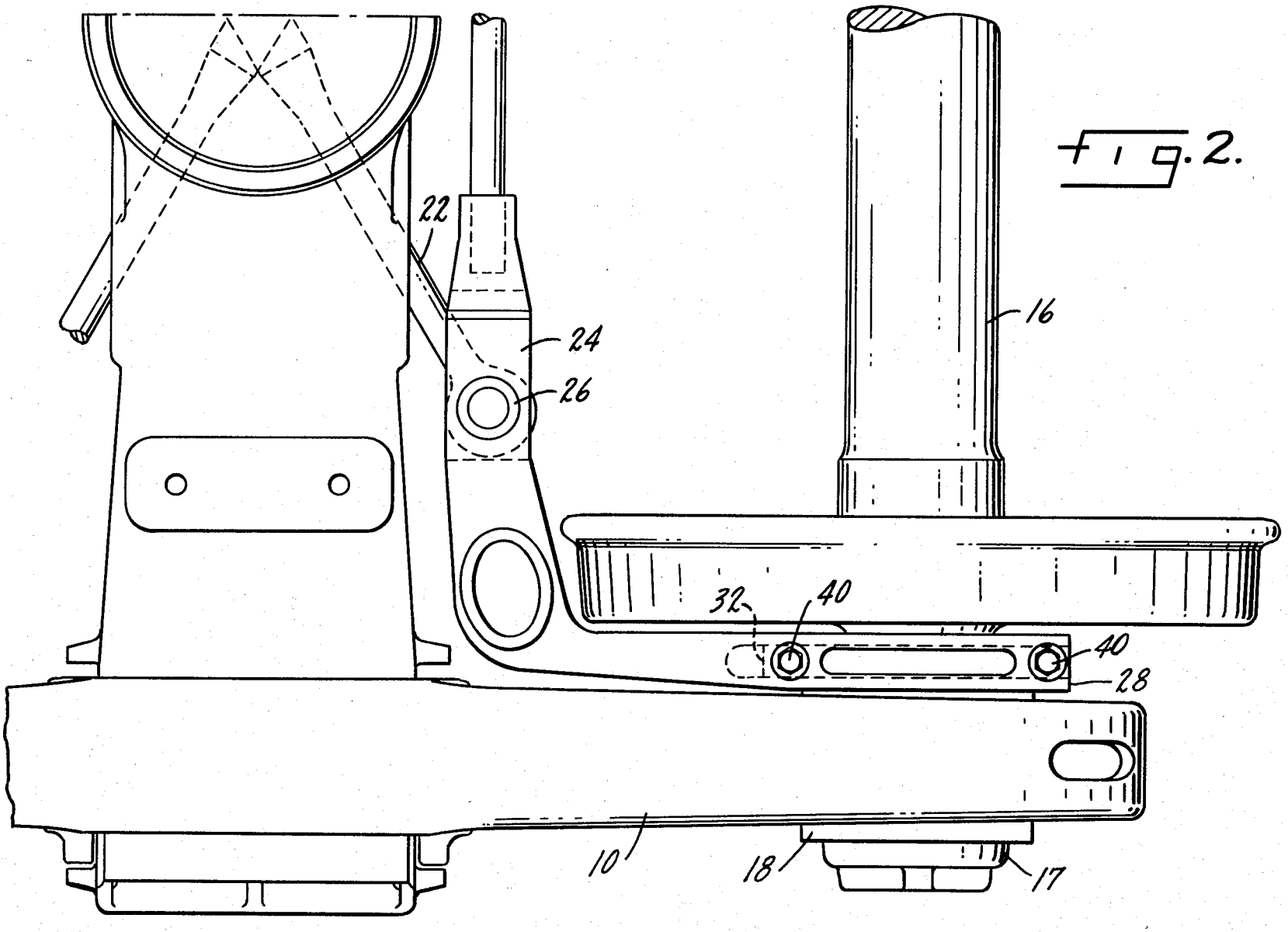
FIG. 2 is a partial top view of the truck of FIG. 1.

Self-steering railroad trucks of the type shown in U.S. Pat. Nos. 4,111,131 and 4,373,446 and the patents of Herbert Scheffel of South Africa provide a truck which is both self-steering and stabilized over a wide speed range for both empty and loaded conditions. However, the truck in construction detail has a 75-inch wheel base or axle spacing, which distance was necessary in order to include the hardware to cross connect opposite corners of the truck, which cross connection provides self-steering. Since unit trains in the United States, one of the prime users of radial-type trucks, normally have cars with a 70-inch wheel base, it has been necessary to redesign the structure shown in the Scheffel patents and in the above-mentioned '131 patent. It was necessary to shorten the wheel base to the conventional 70-inch wheel base so that all cars in the train would have the same wheel base which is necessary to accommodate the automatic dumping apparatus which is conventionally used to empty the cars in unit coal trains or other unit commodity trains.

In addition to shortening the wheel base, it was determined that it would be more advantageous to have a truck which would provide flange free curving until such time as the flanges of the wheels contacted the rails, after which the truck would function in the more conventional manner as a rigid truck and there would then be no self-steering or freedom of movement between the axles and the side frames. Such an arrangement prevents oversteering, providing a more stabilized truck. To provide this advantageous result, the shear pads between the roller bearing adaptor and the side frame have been revised in construction and the permitted movement between the roller bearing adaptors and the side frames has been substantially reduced.

In addition to the above changes, as a part of shortening the wheel base, it was determined that it was advantageous to reduce the weight of the truck. This necessitated moving the subframe which connected opposite corners of the truck from the exterior of the side frame to the interior of the side frame. Otherwise, it would not be possible to include all of the necessary elements in the truck. Such an arrangement required a rigid connection between the subframe and the roller bearing adaptor, whereas in the past the subframe and adaptor have been two separate parts at each journal. The rigid connection between the roller bearing adaptor and the subframe would normally place tremendous dynamic loads on the fasteners or bolts. The present invention is specifically directed to substantially eliminating such dynamic loads from the connecting means or bolts. The present invention is specifically directed to providing a rigid connection in the specified location, but such a connection which protects the fastening means from high fluctuating or repetitive variations in loading, which normally will cause fatigue and consequent failure.

A side frame is indicated at 10 and will mount conventional springs 12 which support bolster 14 in the side frame window. Although only a portion of the railroad car truck is illustrated, there will be two axles, one of which is indicated at 16, with each end of each axle being mounted for rotation within a roller bearing 17 and roller bearing adaptor 18. Shear pads 20 are positioned on top of roller bearing adaptors 18 with the side frames 10 being mounted upon the shear pads. The abovedescribed arrangement permits a small degree of relative horizontal movement between the roller bearing adaptors and the side frame, which movement is necessary to permit or provide for the truck to be self-steering. The amount of such movement will determine the extent to which the truck is self-steering or the extent to which the individual axles may move relative to the side frame. As described above, by limiting the amount of relative movement, there will be no oversteering and the truck will function as a radial truck or self-steering truck up until the point where the flanges contact the rails, after which the truck becomes rigid and will then function in a more conventional manner.

Each of the roller bearing adaptors is connected to the roller bearing adaptor at the opposite corner of the truck. This provides self-steering in that as one axle pivots, the other axle will pivot in the reverse sense, thus permitting the truck to follow the characteristic of the track curve. There are cross rods 22 which are used to interconnect opposite corners of the trucks. Opposite ends of rods 22 are in turn connected to a subframe or arm 24. Note that each subframe 24 consists of a somewhat U-shaped construction which, in addition to providing a connection to the roller bearing adaptor at an opposite corner, serves to connect the roller bearing adaptor at the opposite side of each axle. Subframes 24, will be pivotally connected to arms 22 and will include in such pivotal connection, a polyurethane sleeve 26 which will function as a spring accepting a substantial part of the compressive load applied between arms 24, when the car is being automatically unloaded by a dumper.

Figure 3:
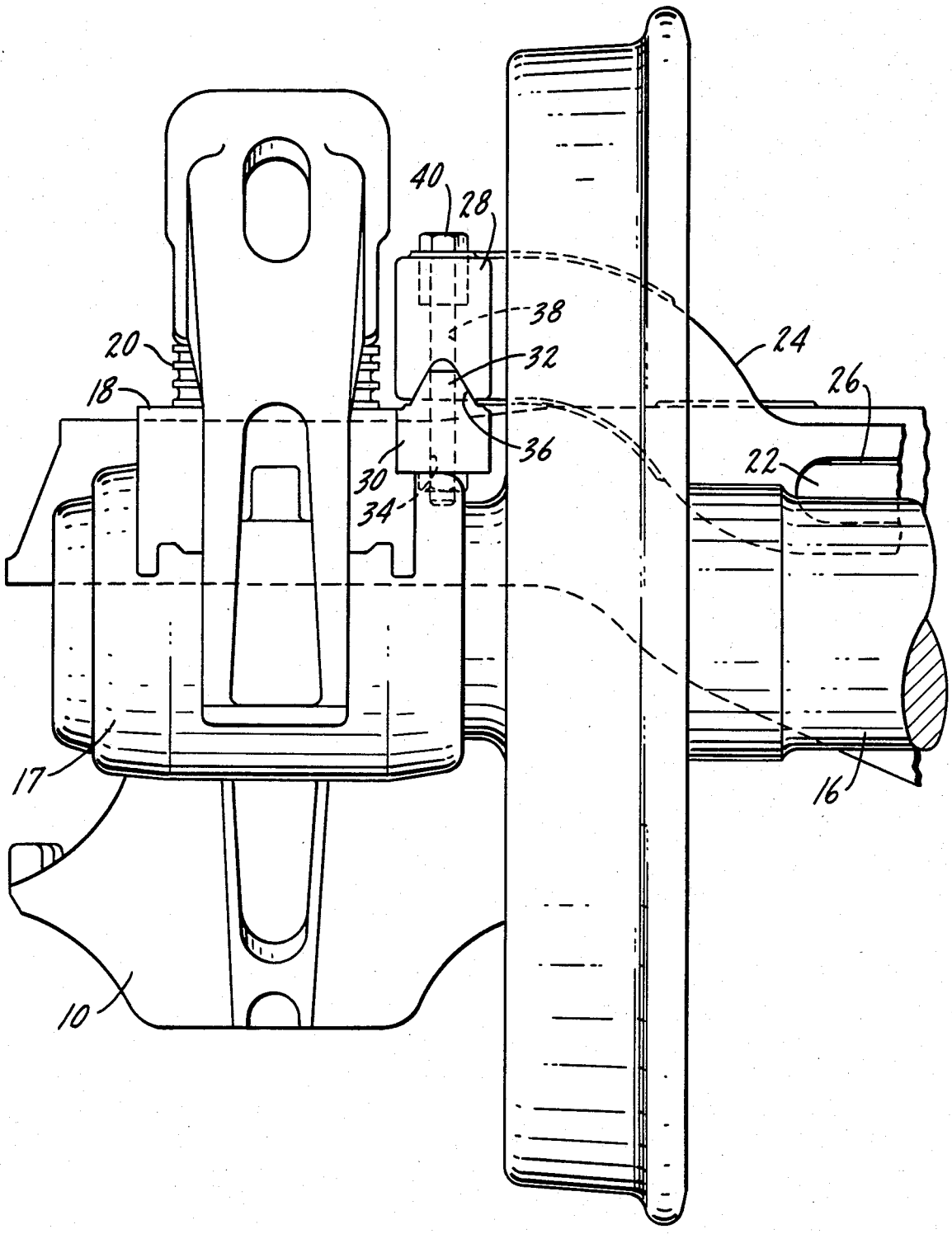
FIG. 3 is an end view of the truck illustrating the improved rigid connection between the roller bearing adaptor and subframe.

Arms 24 extend about each of the wheels, on the inside of the side frame and have a portion 28 which is positioned directly above an interior portion 30 of the roller bearing adaptor (FIG. 3). Looking specifically at portion 30 of the roller bearing adaptor, there are spaced upwardly-extending wedge-shaped projections 32 at opposite ends thereof, with centrally located bores 34 formed in the wedge-shaped projections and in the underlying portions 30. Arm portions 28 have a longitudinal extending wedge-shaped opening 36 which is of a size and shape to match that of wedge-shaped projections or extensions 32 so that the roller bearing adaptor and the subframe may be interlocked. In like manner, there are bores 38 in arm portions 28 which are in alignment with bores 34 in the roller bearing adaptor portions 30. Fastening means 40 extend through the mating bores to thereby rigidly connect the roller bearing adaptors and the subframes.

It is necessary that there be a rigid connection between each subframe and the roller bearing adaptors to use the strength of the axle to hold the subframe arms 24 together, to keep them from bending and to give a high subframe stiffness. Normally, such a rigid connection would be subject to substantial horizontal loads when there is relative horizontal movement between the two axles of the truck. Such loads would quickly destroy bolts which might be used as the fastening means. The high fluctuation or repetitive loading on the bolts caused by such relative movement would quickly cause fatigue and subsequent failure of the bolts. The present invention provides a means whereby the bolts are only subjected to essentially conventional static tension which is normal in a bolted connection. The wedge-shaped extensions fit into mating female grooves or slots with the bolts being on the center line of the wedge-shaped parts. A wedge-shaped construction is preferable and has the advantage that it requires substantially less tolerance in the parts and provides an interlocking mechanism due to the inherent shape of the wedge. The use of such a wedge-shaped construction permits greater horizontal loading on the structure that if the projections had essentially vertical sides, the wedge-shaped construction will actually lock together and there is only minor, if any, tension stress placed on the bolts when there is a substantial horizontal force applied to the wedges of the interconnection.

Figure 4:
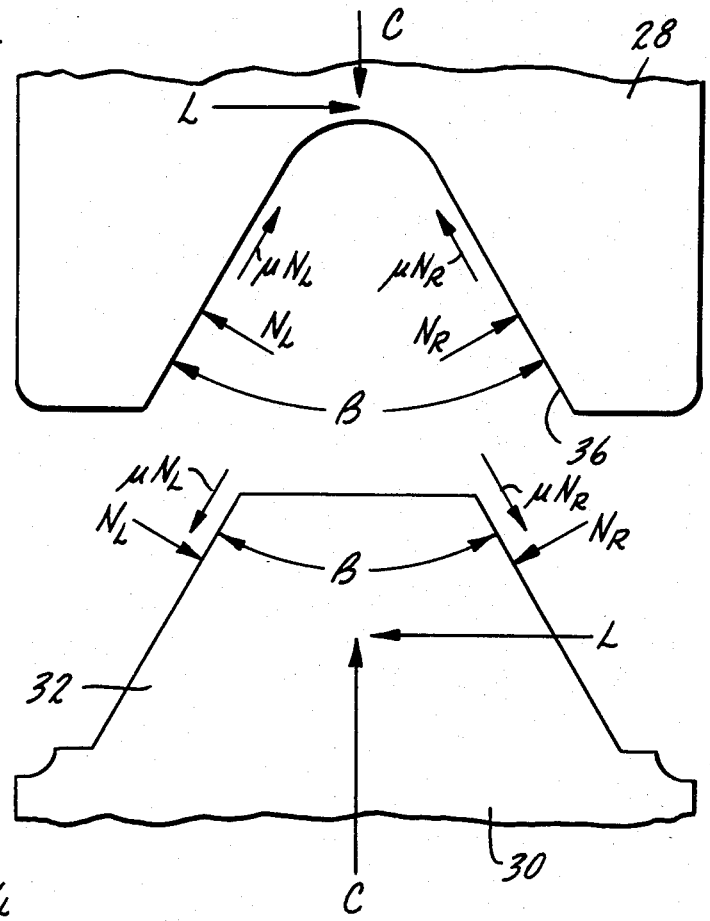
FIG. 4 is an enlarged view illustrating the connection between the subframe and roller bearing adaptor, with vectors representing the applied forces being shown thereon.

Referring to FIG. 4, the vectors shown therein represent the direction and magnitude of the forces applied to the connection between the roller bearing adapter and the subframe. Vector C represents the clamping force due to fastening means 40. Vectors $N_R$ and $N_L$ represent the normal forces acting between the right-hand and left-hand contacting surfaces of elements 36 and 32. $\mu$ represents the coefficient of friction. Vectors $\mu N_R$ and $\mu N_L$ represent the frictional shear forces acting between the right-hand and left-hand contacting surfaces of elements 36 and 32. The included angle between the right-hand and left-hand surfaces of elements 36 and 32 is represented by $\beta$. Vector L represents the horizontal loads acting between the subframe and the roller bearing adapter.

Figure 5A:
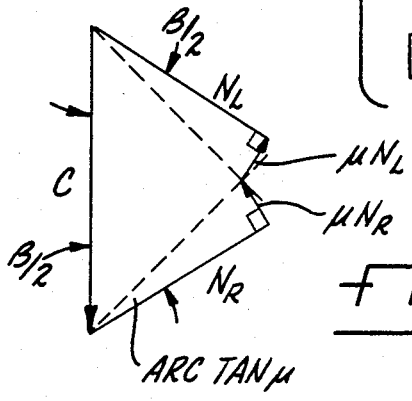
FIG. 5A is a vector diagram representing the forces acting upon the subframe with no horizontal loads acting thereon.

FIG. 5A is a vector force diagram that represents the forces acting upon the subface with no horizontal loads applied to the subframe at the point of connection with the roller bearing adaptor.

Figure 5B:
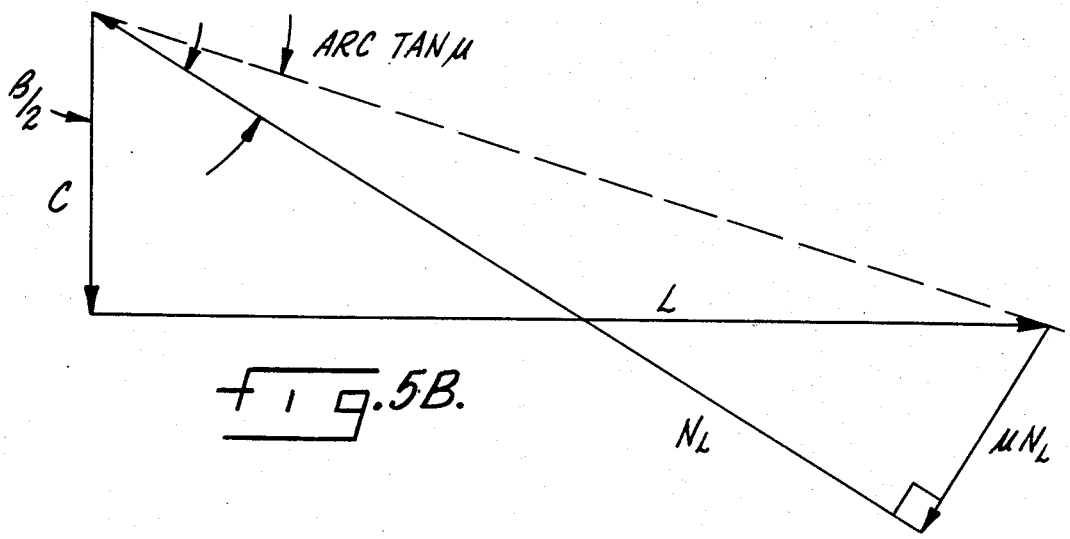
FIG. 5B is a vector force diagram representing the forces acting on the subframe with the maximum horizontal load acting thereon and without any increase in the clamping force applied by the fastening means.

FIG. 5B is a vector force diagram that represents the forces acting upon the subframe. The force diagram illustrates that the permissible horizontal force (L) may greatly exceed the clamping force without any increase in the load or stress applied to the fastening means.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad truck including a pair of side frames with wheeled axles mounted therebetween, a roller bearing adaptor mounted upon each end of each axle with side frames being mounted upon the adaptors, a subframe for connecting opposite corner adaptors, and a rigid connection between each adaptor and the subframe, each rigid connection including an adaptor portion and a subframe portion, said adaptor and subframe portions being relatively vertically disposed and having interlocking parts with slanted walls, and vertical fastening means for connecting said vertically disposed portions extending symmetrically through said interlocking parts, said interlocking parts with slanted walls substantially reduce horizontal shear forces upon said fastening means.

2. The railroad truck of claim 1 further characterized in that said interlocking parts are generally wedge-shaped in cross section, with said fastening means extending centrally through said wedge-shaped parts.

3. The railroad truck of claim 2 further characterized in that said fastening means include spaced bolts, the interlocking part of said adaptor portion being a wedge-shaped upward projection, with the interlocking part of said subframe portion being a wedge-shaped downwardly-extending opening, said bolts extending through the center of said projection and opening.

* * * * *